US007451616B2

(12) United States Patent
Ro

(10) Patent No.: US 7,451,616 B2
(45) Date of Patent: Nov. 18, 2008

(54) REFRIGERATING APPARATUS WITH TURBO COMPRESSOR

(75) Inventor: Soo-hyuk Ro, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 310 days.

(21) Appl. No.: 11/252,754

(22) Filed: Oct. 19, 2005

(65) Prior Publication Data

US 2006/0150668 A1 Jul. 13, 2006

(30) Foreign Application Priority Data

Jan. 10, 2005 (KR) ..... 10-2005-0002201

(51) Int. Cl.
*F25B 31/02* (2006.01)

(52) U.S. Cl. ..... 62/505; 62/510

(58) Field of Classification Search ..... 62/404, 62/510, 512, 505

See application file for complete search history.

(56) References Cited

U.S. PATENT DOCUMENTS

| | | | | |
|---|---|---|---|---|
| 4,884,406 | A * | 12/1989 | Kawamura | 60/605.3 |
| 5,555,956 | A * | 9/1996 | Voss et al. | 184/6.16 |
| 6,471,493 | B2 * | 10/2002 | Choi et al. | 417/350 |
| 6,554,568 | B2 * | 4/2003 | Fledersbacher et al. | 415/166 |
| 6,582,189 | B2 * | 6/2003 | Irie et al. | 415/119 |
| 6,675,594 | B2 * | 1/2004 | Choi et al. | 62/197 |
| 6,698,929 | B2 * | 3/2004 | Choi et al. | 384/103 |
| 6,729,858 | B2 | 5/2004 | Choi et al. | |
| 2001/0000050 | A1 * | 3/2001 | Okazaki et al. | 62/149 |
| 2002/0037225 | A1 * | 3/2002 | Choi et al. | 417/350 |
| 2003/0059315 | A1 * | 3/2003 | Choi et al. | 417/228 |
| 2003/0094007 | A1 * | 5/2003 | Choi et al. | 62/197 |
| 2005/0152786 | A1 * | 7/2005 | Ro et al. | 416/242 |
| 2006/0150668 | A1 * | 7/2006 | Ro | 62/510 |
| 2006/0210418 | A1 * | 9/2006 | Bae et al. | 418/125 |

FOREIGN PATENT DOCUMENTS

| | | |
|---|---|---|
| JP | 43-9797 | 4/1968 |
| JP | 2000-292015 | 10/2000 |
| JP | 2001-95205 | 4/2001 |
| KR | 2003-41574 | 5/2003 |

OTHER PUBLICATIONS

Korean Patent Abstract for Publication No. 1999-43549.
Korean Patent Abstract for Publication No. 1999-54845.
Office Action mailed on Apr. 22, 2008 and issued in corresponding Japanese Patent Application No. 2005-372076.

* cited by examiner

*Primary Examiner*—William E Tapolcai
(74) *Attorney, Agent, or Firm*—Staas & Halsey LLP

(57) ABSTRACT

A refrigerating apparatus, including a turbo compressor including a driving motor and a plurality of bearing members supporting a rotation axis of the driving motor; a condenser provided to condense a refrigerant gas compressed from the turbo compressor; a refrigerant supplying part supplying a part of a refrigerant discharged from an outlet of the condenser to the turbo compressor to cool down the driving motor and the bearing members; and a refrigerant discharging part provided to discharge a cooling refrigerant supplied by the refrigerant supplying part and passing through the turbo compressor. Thus, the refrigerating apparatus cools a driving motor and a bearing member of a turbo compressor without difficulty. Also, the refrigerating apparatus restrains a refrigerant from leaking between an impeller and a diffuser, and increases the efficiency of the turbo compressor.

17 Claims, 3 Drawing Sheets

REFRIGERATING APPARATUS WITH TURBO COMPRESSOR

CROSS-REFERENCE TO RELATED APPLICATIONS

This application claims the benefit of Korean Patent Application No. 2005-0002201, filed on Jan. 10, 2005, in the Korean Intellectual Property Office, the disclosure of which is incorporated herein by reference.

BACKGROUND OF THE INVENTION

1. Field of the Invention

The present invention relates to a refrigerating apparatus with a turbo compressor, and more particularly, to a refrigerating apparatus having an improved structure to efficiently cool a driving motor of a turbo compressor and a bearing member supporting a rotation axis of the driving motor.

2. Description of the Related Art

Generally, a refrigerating apparatus includes a compressor for compressing a gaseous in order to raise the temperature and pressure of the refrigerant; a condenser to condense the gaseous refrigerant compressed in the compressor into a liquid refrigerant; an expansion unit such as a capillary tube or an expansion valve to lower the temperature and pressure of the refrigerant; and an evaporator for absorbing heat from the surrounding air and cooling the surrounding air to evaporate the liquid refrigerant at a low temperature and low pressure received from the expansion unit. Such a refrigerating apparatus is mounted in a refrigerator or an air conditioner and adjusts temperature of a storage portion of the refrigerator or where the air conditioner is disposed.

Hereinbelow, a refrigerator mounted with a turbo compressor will be described as an example.

Generally, the turbo compressor includes a driving motor; a rotating impeller coupled to a rotation axis of the driving motor; a diffuser converting kinetic energy of refrigerant gas discharged by the rotation of the impeller into pressure energy; and a bearing member supporting the rotation axis. While operating, the driving motor and bearing member of the turbo compressor discharge heat at high temperature.

Such a conventional turbo compressor is disclosed in Korean Patent Application No. 1997-64567. The conventional turbo compressor includes a driving motor; a first impeller and a second impeller coupled with the driving motor by a rotation axis and respectively compressing refrigerant gas one after another; a first diffuser and a second diffuser are provided to respectively correspond to the first and second impellers; a motor compartment is provided to accommodate the driving motor; an introducing part provided to introduce a part of the refrigerant gas compressed once by the first impeller and the first diffuser to the motor compartment; and a discharging part is provided to allow the refrigerant gas introduced to the motor compartment to cool down the motor compartment and to be mixed with the refrigerant gas once compressed.

Such introducing and discharging parts are provided between the driving motor and the bearing member supporting the rotation axis of the driving motor and may efficiently cool down the driving motor.

However, the conventional turbo compressor cannot efficiently cool down a plurality of bearing members provided on an outside of the driving motor by the introducing part and the discharging part.

Also, the conventional turbo compressor rotates the impeller with respect to the diffuser, thereby forming a gap between the impeller and the diffuser. As such, the refrigerant gas may leak out through the gap.

SUMMARY OF THE INVENTION

Accordingly, it is an aspect of the present invention to provide a refrigerating apparatus cooling a driving motor and a bearing member of a turbo compressor without difficulty.

It is another aspect of the present invention to provide a refrigerating apparatus restraining a refrigerant leaking between an impeller and a diffuser, and increasing efficiency of the turbo compressor.

Additional aspects and/or advantages of the present invention will be set forth in part in the description which follows and, in part, will be apparent from the description, or may be learned by practice of the present invention.

The foregoing and/or other aspects of the present invention are also achieved by providing a refrigerating apparatus, including a turbo compressor including a driving motor and a plurality of bearing members supporting a rotation axis of the driving motor; a condenser provided to condense a refrigerant gas compressed from the turbo compressor; a refrigerant supplying part supplying a part of a refrigerant discharged from an outlet of the condenser to the turbo compressor to cool down the driving motor and the bearing members; and a refrigerant discharging part provided to discharge a cooling refrigerant supplied by the refrigerant supplying part and passing through the turbo compressor.

According to an aspect of the present invention, the turbo compressor further includes a first compressing part provided on a first side of the driving motor and compressing the refrigerant gas once; and a second compressing part provided on a second side of the driving motor and compressing the refrigerant gas one more time which is once compressed by the first compressing part. The refrigerant supplying part includes a first refrigerant supply opening provided between the first compressing part and the driving motor; and a second refrigerant supply opening provided between the second compressing part and the driving motor.

According to an aspect of the present invention, the plurality of bearing members includes a first bearing member provided between the first compressing part and the driving motor; and a second bearing member provided between the second compressing part and the driving motor. The first refrigerant supply opening is provided between the bearings in the first bearing member, and the second refrigerant supply opening is provided between the second bearing member and the second compressing part.

According to an aspect of the present invention, the turbo compressor further includes a first compressing part provided on a first side of the driving motor and compressing a refrigerant gas once; and a second compressing part provided on a second side of the driving motor and compressing the refrigerant gas one more time which is once compressed by the first compressing part, and the refrigerant discharging part includes a first refrigerant discharging opening provided between the first compressing part and the driving motor; and a second refrigerant discharging opening provided between the second compressing part and the driving motor.

According to an aspect of the present invention, the plurality of bearing members includes a first bearing member provided between the first compressing part and the driving motor; and a second bearing member provided between the second compressing part and the driving motor. The first refrigerant discharging opening is provided between the bearings in the first bearing members and/or between the first bearing member and the driving motor. The second refrigerant discharging opening is provided between the second bearing member and the driving motor.

According to an aspect of the present invention, the refrigerant supplied to the turbo compressor through the refrigerant supplying part is 5% through 10% of the cooling refrigerant discharged from the outlet of the condenser.

According to an aspect of the present invention, the refrigerating apparatus further includes a pressure adjuster for adjusting the pressure of the cooling refrigerant supplied to the turbo compressor through the refrigerant supplying part.

According to an aspect of the present invention, the turbo compressor further includes a first compressing part provided on a first side of the driving motor, and compressing the refrigerant gas once; and a second compressing part provided on a second side of the driving motor and compressing the refrigerant gas one more time which is once compressed by the first compressing part, and the pressure adjuster adjusts the pressure of the cooling refrigerant supplied through the refrigerant supplying part to be higher than that of the refrigerant gas of an area of the first compressing part.

According to an aspect of the present invention, the refrigerating apparatus further includes an accumulator supplying the refrigerant gas to the turbo compressor to be compressed, and the refrigerant discharging part is provided to supply the cooling refrigerant discharged from the turbo compressor to the accumulator.

According to an aspect of the present invention, the turbo compressor further includes a first compressing part provided on a first side of the driving motor and compressing the refrigerant gas once; and a second compressing part provided on a second side of the driving motor and compressing the refrigerant gas one more time which is once compressed by the first compressing part, further including a first refrigerant connecting part provided to mix a part of the refrigerant discharged from the outlet of the condenser with the cooling refrigerant discharged from the refrigerant discharging part; and a second refrigerant connecting part supplying the cooling refrigerant mixed by the first refrigerant connecting part to the turbo compressor to be mixed with the refrigerant gas once compressed by the first compressing part.

BRIEF DESCRIPTION OF THE DRAWINGS

The above and/or other aspects and advantages of the present invention will become apparent and more readily appreciated from the following description of the embodiments, taken in conjunction with the accompany drawings of which.

DETAILED DESCRIPTION OF THE PREFERRED EMBODIMENTS

Figure 1:
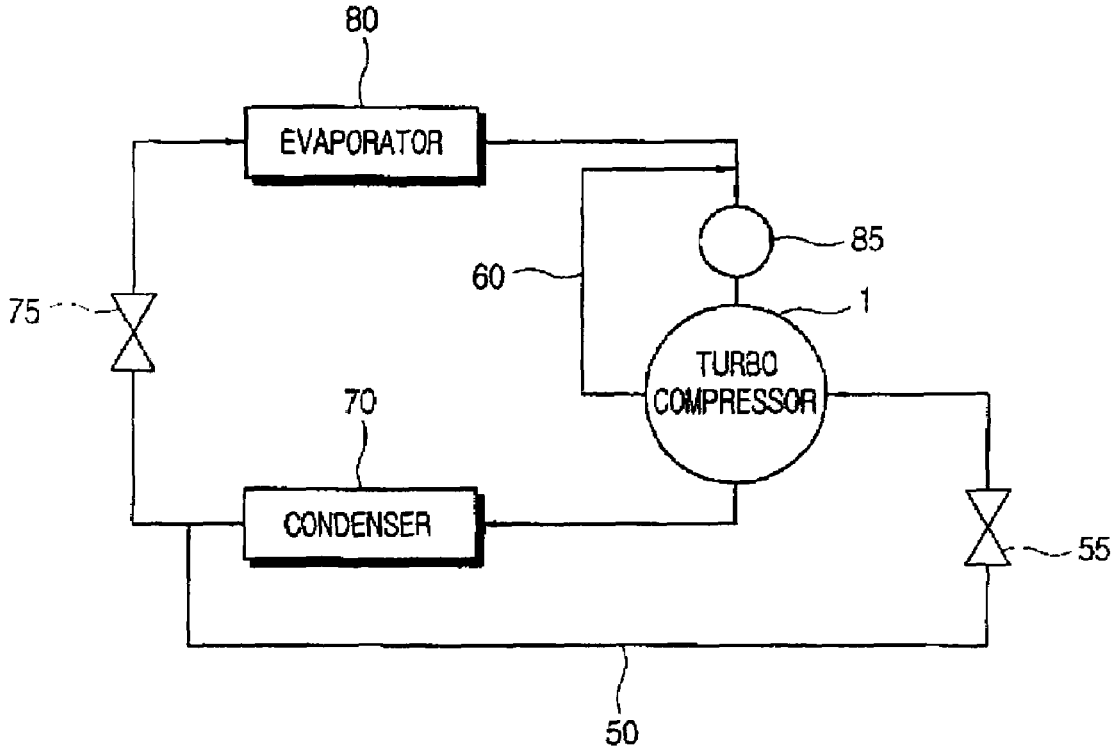
FIG. 1 is a schematic view of a refrigerating apparatus according to a first embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
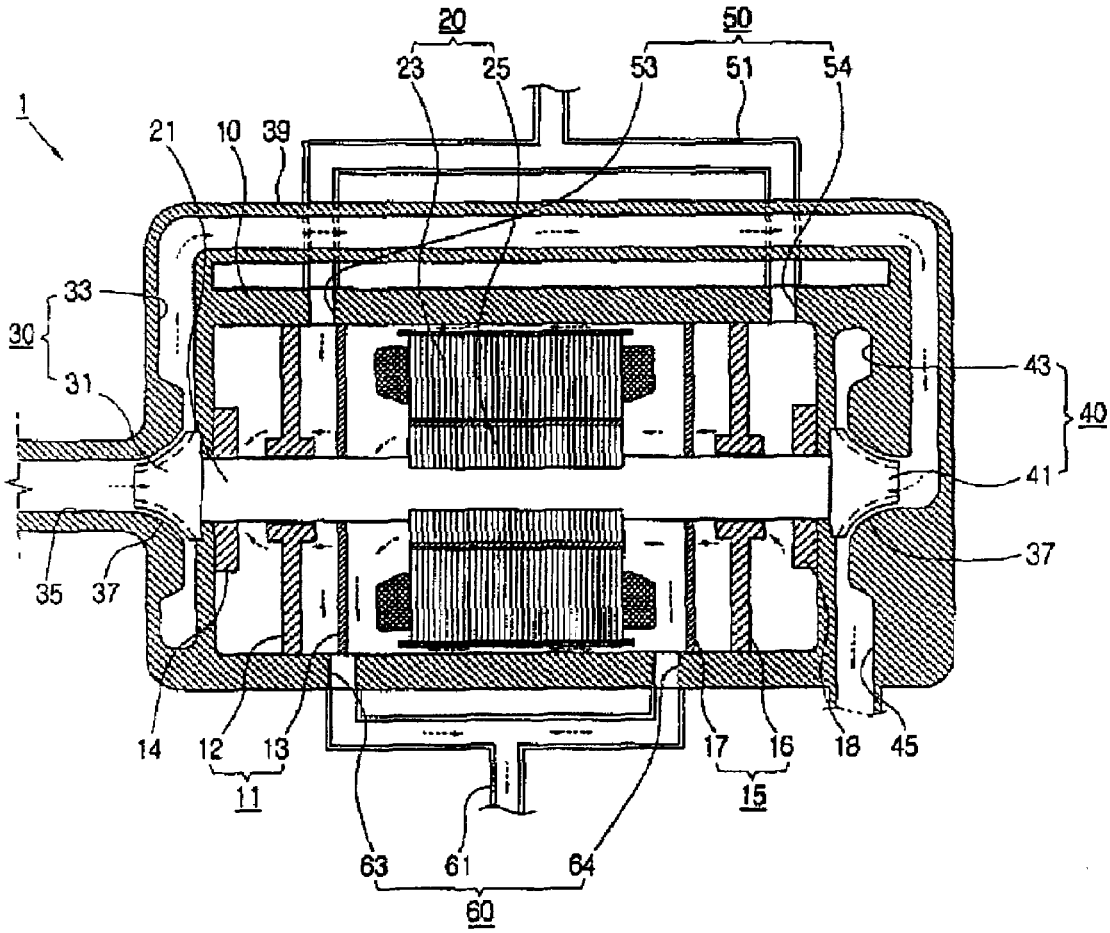
FIG. 2 is a schematic sectional view of a turbo compressor of the refrigerating apparatus in FIG. 1.

As shown in FIG. 2, a turbo compressor which is provided in a refrigerating apparatus according to the present invention compresses a refrigerant gas twice. Alternatively, the turbo compressor may compress the refrigerant gas once, three times, or more.

First Embodiment

As shown in FIGS. 1 and 2, a refrigerating apparatus includes a turbo compressor 1 including a driving motor 20 and a plurality of bearing members 11 and 15 supporting a rotation axis 21 of the driving motor 20; a condenser 70 condensing a refrigerant gas compressed from the turbo compressor 1; a refrigerant supplying part 50 supplying a part of the refrigerant discharged from an outlet of the condenser 70 to the turbo compressor 1 to cool down the driving motor 20 and the bearing members 11 and 15; and a refrigerant discharging part 60 discharging a cooling refrigerant supplied by the refrigerant supplying part 50 and passing through the turbo compressor 1. The refrigerating apparatus according to the first embodiment of the present invention further includes an expansion unit 75 converting the refrigerant liquefied through the turbo compressor 1 and the condenser 70 into low temperature and low pressure; an evaporator 80 evaporating the refrigerant transmitted from the expansion unit 75 and cooling down the surrounding air; and an accumulator 85 dividing the refrigerant supplied from the evaporator 80 into the liquid and gaseous refrigerant and supplying the gaseous refrigerant to the turbo compressor 1.

The turbo compressor 1 further includes a first compressing part 30 provided on a first side of the driving motor 20 and compressing the refrigerant gas once; and a second compressing part 40 provided on a second side of the driving motor 20 and compressing the refrigerant gas one more time which is compressed once by the first compressing part 30. The turbo compressor 1 further includes a motor casing 10 supporting the driving motor 20 and the plurality of bearing members 11 and 15.

The driving motor 20 includes a stator 23 integrally coupled to the motor casing 10 and a rotor 25 spaced at a predetermined distance and rotatably inserted into the stator 23.

The rotation axis 21 is rotatably provided, wherein a center thereof is coupled with the rotor 25 of the driving motor 20, a first side thereof is coupled with a first impeller 31 of the first compressing part 30, and a second side thereof is coupled with the second impeller 41 of the second compressing part 40. Also, the rotation axis 21 is supported by the plurality of bearing members 11 and 15 to be rotated at a high velocity by the driving motor 20.

The plurality of bearing members 11 and 15 includes a first bearing member 11 provided between the first compressing part 30 and the driving motor 20; and a second bearing member 15 provided between the second compressing part 40 and the driving motor 20.

The first bearing member 11 is provided as a pair of bearings spaced from each other to support the rotation axis 21. That is, the first bearing member 11 is provided as a first thrust bearing 13 supporting the rotation axis 21 in the axial direction and a first radial bearing 12 supporting the rotation axis 21 in the radial direction. Alternatively, the first bearing member 11 may be provided as a single bearing or three or more bearings.

The second bearing member 15 is provided as a pair of bearings spaced from each other to support the rotation axis 21 like the first bearing member 11. That is, the second bearing member 15 is provided as a second thrust bearing 17 supporting the rotation axis 21 in the axial direction and a second radial bearing 16 supporting the rotation axis 21 in the radial direction. Alternatively, the second bearing member 15 may be provided as a single bearing or three or more bearings.

The motor casing 10 forms a predetermined accommodating space to accommodate and support the driving motor 20 and the bearing members 11 and 15. On opposite sides of the motor casing 10 are provided a first sealing member 14 and a second sealing member 18 to prevent the refrigerant gas from leaking out from the first compressing part 30 and the second compressing part 40.

The first compressing part 30 includes the first impeller 31 rotatably provided to couple with a first side of the rotation axis 21; a first diffuser 33 provided to compress the refrigerant gas discharged from the first impeller 31; and a shroud 37 accommodating the first impeller 31 and being spaced from the first impeller 31. The first compressing part 30 couples with a refrigerant gas inhaler 35 connected with the shroud 37 and guiding the refrigerant gas to the first impeller 31; and a refrigerant gas mover 39 moving the refrigerant gas compressed once by the first impeller 31 and the first diffuser 33 to the second compressing part 40.

The second compressing part 40 includes the second impeller 41 rotatably provided to couple with a second side of the rotation axis 21; a second diffuser 43 provided to compress the refrigerant gas discharged from the second impeller 41; and a shroud 37 accommodating the second impeller 41 and being spaced from the second impeller 41. The second compressing part 40 is connected with a refrigerant gas discharger 45 discharging the refrigerant gas compressed for the second time by the second impeller 41 and the second diffuser 43 to the condenser 70.

The refrigerant supplying part 50 includes a refrigerant supplying pipe 51 divided from the outlet of the condenser 70 to cool down the driving motor 20 and the bearing members 11 and 15 generating heat at high temperature in the turbo compressor 1 by using a part of the refrigerant at high pressure discharged to the outlet of the condenser 70; and first and second refrigerant supply openings 53 and 54 provided in the motor casing 10 of the turbo compressor 1 to be connected with the refrigerant supplying pipe 51. The refrigerant supplying part 50 may supply five through ten percent of the refrigerant discharged from the condenser 70 to the turbo compressor 1. However, the quantity of the refrigerant supplied to the turbo compressor 1 is not limited to five through ten percent. Alternatively, the refrigerant supplying part 50 may supply less than five percent or more than ten percent of the refrigerant discharged from the condenser 70 to the turbo compressor 1. In the refrigerant supplying part 50 may be provided a pressure adjuster 55 adjusting the pressure of the cooling refrigerant supplied to the turbo compressor 1 through the refrigerant supplying part 50.

The first and second refrigerant supply openings 53 and 54 are provided as a pair in the motor casing 10 to supply the cooling refrigerant to the driving motor 20 and the bearing members 11 and 15. The first refrigerant supply opening 53 is provided between the first compressing part 30 and the driving motor 20. The second refrigerant supply opening 54 is provided between the second compressing part 40 and the driving motor 20. Alternatively, there may be one or three or more refrigerant supply openings to supply the cooling refrigerant to the driving motor 20 and the bearing members 11 and 15.

As an example of the present invention, the first refrigerant supply opening 53 may be provided between the bearings of the first bearing member 11. That is, the first refrigerant supply opening 53 may be provided between the first radial bearing 12 and the first thrust bearing 13 as shown in FIG. 2. Alternatively, the first refrigerant supply opening 53 may be provided between the first sealing member 14 and the first radial bearing 12, or between the first thrust bearing 13 and the driving motor 20.

As an example of the present invention, the second refrigerant supply opening 54 may be provided between the second bearing member 15 and the second compressing part 40. That is, the second refrigerant supply opening 54 may be provided between the second radial bearing 16 and the second sealing member 18 as shown in FIG. 2. Alternatively, the second refrigerant supply opening 54 may be provided between the driving motor 20 and the second thrust bearing 17, or between the second thrust bearing 17 and the second radial bearing 16.

As an example of the present invention, the pressure adjuster 55 may be shaped like a valve to adjust the pressure of the cooling refrigerant discharged from the outlet of the condenser 70 to the refrigerant supplying part 50. However, the shape of the pressure adjuster 55 is not limited to a valve. Alternatively, the pressure adjuster 55 may be provided as various shapes to adjust the pressure of the cooling refrigerant discharged to the refrigerant supplying part 50. The pressure adjuster 55 may adjust the pressure of the cooling refrigerant supplied through the refrigerant supplying part 50 to be higher than that of the area of the first compressing part 30. As an example of the present invention, the pressure adjuster 55 adjusts the pressure of the cooling refrigerant supplied through the refrigerant supplying part 50 to exist between the pressure of the refrigerant gas of the area of the first compressing part 30 and that of the refrigerant gas of the area of the second compressing part 40. Alternatively, the pressure adjuster 55 may adjust the pressure of the cooling refrigerant supplied through the refrigerant supplying part 50 to be interposed between the pressure of the refrigerant around the outlet of the condenser 70 and that of the refrigerant gas of the area of the first compressing part 30.

The refrigerant discharging part 60 includes first and second refrigerant discharging openings 63 and 64 provided in the motor casing 10 and allowing the cooling refrigerant to cool the driving motor 20 and bearing members 11 and 15 of the turbo compressor 1 and to be discharged; and a refrigerant discharging pipe 61 moving the cooling refrigerant discharged through the first and second refrigerant discharging openings 63 and 64 to be compressed by the turbo compressor 1.

The first and second refrigerant discharging openings 63 and 64 are provided in the motor casing 10 as a pair to discharge the cooling refrigerant cooling the driving motor 20 and the bearing members 11 and 15. The first refrigerant discharging opening 63 is provided between the first compressing part 30 and the driving motor 20. The second refrigerant discharging opening 64 is provided between the second compressing part 40 and the driving motor 20. Alternatively, there may be one or three or more refrigerant discharging openings to discharge the cooling refrigerant cooling the driving motor 20 and the bearing members 11 and 15.

As an example of the present invention, the first refrigerant discharging opening 63 may be provided between the bearings of first bearing member 11, and/or between the first bearing member 11 and the driving motor 20. That is, the first refrigerant discharging opening 63 may be provided between the first radial bearing 12 and the first thrust bearing 13, or between the first thrust bearing 13 and the driving motor 20 to discharge the cooling refrigerant. Alternatively, the first refrigerant discharging opening 63 may be provided between the first sealing member 14 and the first radial bearing 12.

As an example of the present invention, the second refrigerant discharging opening 64 may be provided between the second bearing member 15 and the driving motor 20. That is, the second refrigerant discharging opening 64 may be provided between the driving motor 20 and the second thrust bearing 17 to discharge the cooling refrigerant as shown in FIG. 2. Alternatively, the second refrigerant discharging opening 64 may be provided between the second thrust bearing 17 and the second radial bearing 16, or between the second radial bearing 16 and the second sealing member 18.

The refrigerant discharging pipe 61 connects the first and second refrigerant discharging openings 63 and 64 and an entrance of the accumulator 85 to supply the cooling refrigerant discharged through the first and second refrigerant discharging openings 63 and 64 to the accumulator 85.

With this configuration, the process of operating the refrigerating apparatus according to the first embodiment of the present invention is as follows.

First, electric power is applied to the turbo compressor 1. The driving motor 20 rotates the rotation axis 21 to rotate the first impeller 31 and the second impeller 41, and the first compressing part 30 and the second compressing part 40 compress the refrigerant gas. Then, the refrigerant compressed from the turbo compressor 1 is supplied to the condenser 70 to be condensed, and a part of the refrigerant discharged from the condenser 70 is supplied to the turbo compressor 1 and cools down the driving motor 20 and the bearing members 11 and 15 of the turbo compressor 1. In the motor casing 10, the first refrigerant supply pipe 53 may be provided between the first radial bearing 12 and the first thrust bearing 13, and the second refrigerant supply pipe 54 may be provided between the second radial bearing 16 and the second sealing member 18. Thus, the cooling refrigerant supplied through the refrigerant supply pipes 53, 54 cool down the first bearing member 11, the second bearing member 15 and the driving motor 20 as the cooling refrigerant is discharged to the first and second refrigerant discharging openings 63 and 64.

As the pressure of the cooling refrigerant supplied through the refrigerant supplying part 50 is set higher than that of the refrigerant gas of the first compressing part 30, the refrigerant leaking from the first compressing part 30 through the first sealing member 14 and the refrigerant leaking from the second compressing part 40 through the second sealing member 18 may be obstructed. That is, the pressure of the refrigerant leaking from the second compressing part 40 is much lowered when passing through the gap between the second sealing member 18 and the rotation axis 21 so that the leakage of the refrigerant may be obstructed by the cooling refrigerant at a relatively high pressure through the second sealing member 18.

As the pressure of the cooling refrigerant supplied through the refrigerant supplying part 50 is set higher than that of the refrigerant gas of the first compressing part 30, a part of the cooling refrigerant supplied inside the motor casing 10 may be provided to go inside the first compressing part 30 through the gap of the first impeller 31 and the first diffuser 33 of the first compressing part 30. At this time, the temperature of the cooling refrigerant supplied through the refrigerant supplying part 50 is set lower than that of the refrigerant gas of the first compressing part 30, and the cooling refrigerant supplied through the gap between the first impeller 31 and the first diffuser 33 lowers the temperature of the refrigerant gas of the first compressing part 30, thereby increasing compressing efficiency of the turbo compressor 1. That is, the lower the temperature of the refrigerant gas supplied to the second compressing part 40 is, the more efficiently the second compressing part 40 compresses the refrigerant gas. As an example of the present invention, the temperature of the refrigerant gas of the first compressing part 30 is approximately 60 degrees, and that of the cooling refrigerant supplied to the motor casing 10 is approximately 40 degrees.

Also, the rest of the cooling refrigerant supplied to the motor casing 10 is supplied to the accumulator 85 through the refrigerant discharging part 60.

Thus, the refrigerating apparatus according to the first embodiment of the present invention includes the refrigerant supplying part supplying a part of the refrigerant discharged from the outlet of the condenser to the turbo compressor to cool down the driving motor and the bearing members; and the refrigerant discharging part discharging the cooling refrigerant supplied by the refrigerant supplying part and passing through the turbo compressor, thereby efficiently cooling down the driving motor and the bearing members. As the pressure of the cooling refrigerant supplied through the refrigerant supplying part is set higher than that of the refrigerant gas of the first compressing part, the refrigerant gas is prevented from leaking from the first and second compressing parts. Also, the temperature of the refrigerant gas of the first compressing part is lowered, thereby increasing the compressing efficiency of the turbo compressor.

Second Embodiment

Figure 3:
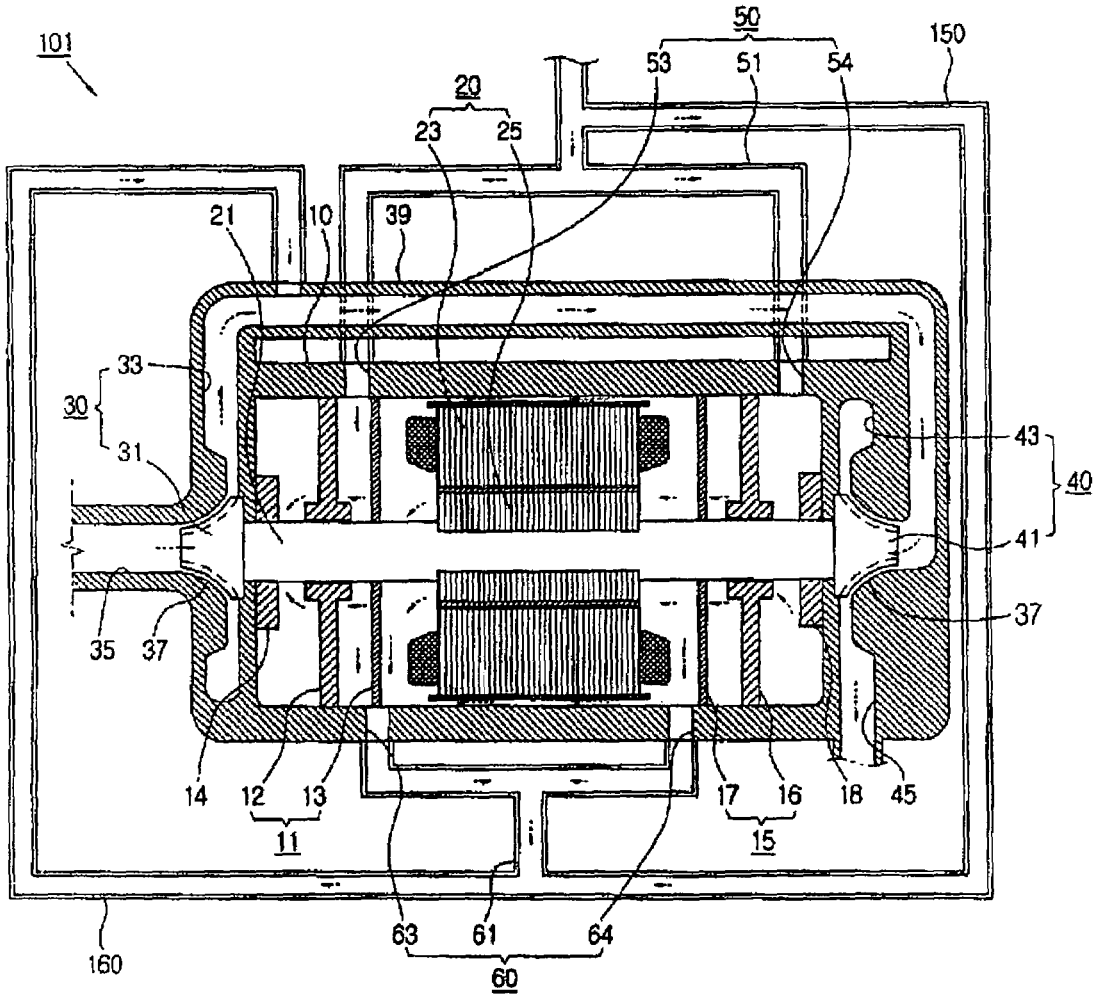
FIG. 3 is a schematic sectional view of a turbo compressor of a refrigerating apparatus according to a second embodiment of the present invention.

As shown in FIG. 3, a refrigerating apparatus according to a second embodiment of the present invention is differentiated from the first embodiment in that the refrigerating apparatus according to the second embodiment includes a first refrigerant connecting part 150 provided to mix a part of the refrigerant discharged from an outlet of the condenser 70 with the cooling refrigerant discharged from the refrigerant discharging part 60; and a second refrigerant connecting part 160 supplying the cooling refrigerant mixed by the first refrigerant connecting part 150 to a turbo compressor 101 to be mixed with refrigerant gas compressed once by the first compressing part 30. In the second embodiment of the present invention, the cooling refrigerant discharged from the refrigerant discharging part 60 is mixed with the cooling refrigerant supplied from the first refrigerant connecting part 150 to lower temperature, and then supplied to the refrigerant gas moving part 39 provided between the first compressing part 30 and the second compressing part 40 through the second refrigerant connecting part 160, instead of being supplied to an accumulator 85.

With this configuration, the refrigerating apparatus according to the second embodiment of the present invention lowers the temperature of the refrigerant gas discharged from the first compressing part 30 by the cooling refrigerant supplied to the refrigerant gas moving part 39 by the first refrigerant connecting part 150 and the second refrigerant connecting part 160, thereby increasing the compressing efficiency of the second compressing part 40. As an example of the present invention, the temperature of the refrigerant gas discharged from the first compressing part 30 may be approximately 60 degrees, and that of the cooling refrigerant supplied from the second refrigerant connecting part 160 may be approximately 50 degrees.

Thus, the refrigerating apparatus according to the second embodiment of the present invention lowers the temperature of the refrigerant gas discharged from the first compressing part, thereby increasing the efficiency of the turbo compressor.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerating apparatus, comprising:

a turbo compressor comprising a driving motor and a plurality of bearing members supporting a rotation axis of the driving motor;

a condenser provided to condense a refrigerant gas compressed from the turbo compressor;

a refrigerant supplying part supplying a part of a refrigerant discharged from an outlet of the condenser to the turbo compressor to cool down the driving motor and the bearing members; and a refrigerant discharging part provided to discharge a cooling refrigerant supplied by the refrigerant supplying part and passing through the turbo compressor, wherein the turbo compressor further comprises a first compressing part provided on a first side of the driving motor and compressing the refrigerant gas once;

a second compressing part provided on a second side of the driving motor and compressing the refrigerant gas one more time which is once compressed by the first compressing part;

a first refrigerant connecting part provided to mix a part of the refrigerant discharged from the outlet of the condenser with the cooling refrigerant discharged from the refrigerant discharging part; and a second refrigerant connecting part supplying the cooling refrigerant mixed by the first refrigerant connecting part to the turbo compressor to be mixed with the refrigerant gas once compressed by the first compressing part.

2. The refrigerating apparatus according to claim 1, wherein the refrigerant supplying part comprises a first refrigerant supply opening provided between the first compressing part and the driving motor and a second refrigerant supply opening provided between the second compressing part and the driving motor.

3. The refrigerating apparatus according to claim 2, wherein the plurality of bearing members comprises:

a first bearing member having a plurality of bearings provided between the first compressing part and the driving motor; and a second bearing member having a plurality of bearings provided between the second compressing part and the driving motor, wherein the first refrigerant supply opening is provided between the bearings of the first bearing member, and the second refrigerant supply opening is provided between the second bearing member and the second compressing part.

4. The refrigerating apparatus according to claim 1, wherein the refrigerant discharging part comprises a first refrigerant discharging opening provided between the first compressing part and the driving motor and a second refrigerant discharging opening provided between the second compressing part and the driving motor.

5. The refrigerating apparatus according to claim 4, wherein the plurality of bearing members comprises:

a first bearing member having a plurality of bearings provided between the first compressing part and the driving motor; and a second bearing member having a plurality of bearings provided between the second compressing part and the driving motor, wherein the first refrigerant discharging opening is provided between the plurality of bearings of the first bearing member and/or between the first bearing member and the driving motor, and the second refrigerant discharging opening is provided between the second bearing member and the driving motor.

6. The refrigerating apparatus according to claim 1, wherein the refrigerant supplied to the turbo compressor through the refrigerant supplying part is 5% through 10% of the cooling refrigerant discharged from the outlet of the condenser.

7. The refrigerating apparatus according to claim 1, further comprising a pressure adjuster adjusting the pressure of the cooling refrigerant supplied to the turbo compressor through the refrigerant supplying part.

8. The refrigerating apparatus according to claim 7, wherein the pressure adjuster adjusts the pressure of the cooling refrigerant supplied through the refrigerant supplying part to be higher than that of the refrigerant gas of an area of the first compressing part.

9. The refrigerating apparatus according to claim 1, further comprising an accumulator supplying the refrigerant gas to the turbo compressor to be compressed, wherein the refrigerant discharging part is provided to supply the cooling refrigerant discharged from the turbo compressor to the accumulator.

10. A cooling device for cooling a space, comprising:

a driving motor having a rotation axis supported by a plurality of bearing members;

a turbo compressor compressing a refrigerant, the turbo compressor being coupled to the rotation axis of the driving motor;

a condenser provided to condense the refrigerant compressed by the turbo compressor;

a refrigerant supplying part supplying a part of a refrigerant discharged from an outlet of the condenser to the turbo compressor to cool down the driving motor and the pluralitv of bearing members; and a refrigerant discharging part provided to discharge the refrigerant supplied by the refrigerant supplying part and passing through the turbo compressor, wherein the turbo compressor further comprises a first compressing part provided on a first side of the driving motor to compress the refrigerant for a first time;

a second compressing part provided on a second side of the driving motor to compress the refrigerant gas a second time after being first compressed by the first compressing part;

a first refrigerant connecting part to mix a part of the refrigerant discharged from the outlet of the condenser with the cooling refrigerant discharged from the refrigerant discharging part; and a second refrigerant connecting part supplying the cooling refrigerant mixed by the first refrigerant connecting part to the turbo compressor to be mixed with the refrigerant gas first compressed by the first compressing part.

11. The cooling device of claim 10, wherein the refrigerant supplying part comprises:

a first refrigerant supply opening provided between the first compressing part and the driving motor; and a second refrigerant supply opening provided between the second compressing part and the driving motor.

12. The cooling device of claim 11, wherein the plurality of bearing members comprises:

a first bearing member having a plurality of bearings provided between the first compressing part and the driving motor; and a second bearing member having a plurality of bearings provided between the second compressing part and the driving motor, wherein the first refrigerant supply opening is provided between the bearings of the first bearing member and the second refrigerant supply opening is provided between the second bearing member and the second compressing part.

13. The cooling device of claim 12, wherein the refrigerant discharging part comprises:

a first refrigerant discharging opening provided between the first compressing part and the driving motor; and a second refrigerant discharging opening provided between the second compressing part and the driving motor.

14. The cooling device of claim 13, wherein the first refrigerant discharging opening is provided between the plurality of bearings of the first bearing member and/or between the first bearing member and the driving motor, and the second refrigerant discharging opening is provided between the second bearing member and the driving motor.

15. The cooling device of claim 10, wherein five to ten percent of the refrigerant discharged from the outlet of the condenser is discharged to the turbo compressor through the refrigerant supplying part.

16. The cooling device of claim 10, further comprising a pressure adjuster for adjusting the pressure of the refrigerant supplied to the turbo compressor through the refrigerant supplying part.

17. The cooling device of claim 10, further comprising an accumulator for supplying the refrigerant to the turbo compressor, wherein the refrigerant discharging part supplies the refrigerant discharged from the turbo compressor to the accumulator.

* * * * *

UNITED STATES PATENT AND TRADEMARK OFFICE

CERTIFICATE OF CORRECTION

PATENT NO. : 7,451,616 B2
APPLICATION NO. : 11/252754
DATED : November 18, 2008
INVENTOR(S) : Soo-hyuk Ro It is certified that error appears in the above-identified patent and that said Letters Patent is hereby corrected as shown below:

Column 10, Line 41, change “pluralitv” to --plurality--.

Signed and Sealed this

Seventeenth Day of February, 2009

JOHN DOLL
*Acting Director of the United States Patent and Trademark Office*